US006502626B1

(12) United States Patent
Mascanzoni et al.

(10) Patent No.: US 6,502,626 B1
(45) Date of Patent: Jan. 7, 2003

(54) CONTINUOUS CASTING PROCESS FOR PRODUCING LOW CARBON STEEL STRIPS AND STRIPS SO OBTAINABLE WITH GOOD AS CAST MECHANICAL PROPERTIES

(75) Inventors: Antonio Mascanzoni, Rome (IT); Ettore Anelli, Rome (IT)

(73) Assignees: Acciai Speciali Terni S.p.A., Terni (IT); Voest-Alpine Industrieanlagenbau GmbH, Linz (AU)

( * ) Notice: Subject to any disclaimer, the term of this patent is extended or adjusted under 35 U.S.C. 154(b) by 0 days.

(21) Appl. No.: 09/446,242

(22) PCT Filed: Jun. 19, 1998

(86) PCT No.: PCT/IT98/00168

§ 371 (c)(1),
(2), (4) Date: Apr. 28, 2000

(87) PCT Pub. No.: WO98/57767

PCT Pub. Date: Dec. 23, 1998

(30) Foreign Application Priority Data

Jun. 19, 1997 (IT) ..... RM97A0367

(51) Int. Cl.[7] ..... B22D 11/22
(52) U.S. Cl. ..... 164/476; 164/480
(58) Field of Search ..... 164/480, 476, 164/428, 479, 429

(56) References Cited

U.S. PATENT DOCUMENTS 5,584,337 A * 12/1996 Nakashima et al. ..... 164/477
5,901,777 A * 5/1999 Matsumura et al. ..... 164/475

FOREIGN PATENT DOCUMENTS

EP 0 707 908 A 4/1996
JP 07197195 A * 12/1993
WO 95/13155 5/1995
WO 0 706 845 A 4/1996

OTHER PUBLICATIONS

Patent Abstracts of Japan, vol. 095, No. 011, Dec. 26, 1995.

Patent Abstracts of Japan, vol. 018, No. 686 (C–1292), Dec. 26, 1994.

C.W. Wegst: "Stahlschlussel" 1989, Verlag Stahlschlussel Wegsr GmbH Marbach, DE XP002079203.

* cited by examiner

*Primary Examiner*—M. Alexandra Elve
*Assistant Examiner*—Len Tran
(74) *Attorney, Agent, or Firm*—Browdy and Neimark, PLLC

(57) ABSTRACT

A process for the production of low carbon steel strips having a good combination of strength an formability, as cast, and a good weldability after the pickling by usual processes, comprising the following steps: casting, in a twin rolls continuous casting machine (1) comprising pinch rolls (3), a strip with a thickness comprised between 1 and 8 mm, having the following composition as weight percentage of the total weight: C 0.02–0.10; Mn 0.1–0.6; Si 0.02–0.35; Al 0.01–0.05; S<0.015; P<0.02; Cr 0.05–0.35; Ni 0.05–0.3; N 0.003–0.012; and, optionally, Ti<0.03; V<0.10; Nb<0.035, the remaining part being substantially Fe; cooling the strip in the area comprised between the casting-rolls and the pinch rolls (3); hot deforming the strip cast through said pinch rolls (3) at a temperature comprised between 1000 and 1300° C. until reaching a thickness reduction less than 15%, in order to encourage the closing of the shrinkage porosites; cooling the strip at a speed comprised between 5 and 80° C./s down to a temperature (Tavv) comprised between 500 and 850° C.; and coiling into a reel (5) the so obtainable strip.

5 Claims, 12 Drawing Sheets

CONTINUOUS CASTING PROCESS FOR PRODUCING LOW CARBON STEEL STRIPS AND STRIPS SO OBTAINABLE WITH GOOD AS CAST MECHANICAL PROPERTIES

FIELD OF THE INVENTION

The present invention refers to a process for the production of low carbon steel strips, having a good combination of strength and cold formability, as cast.

Different methods for producing carbon steel strips through twin roll continuous casting devices are already known. These methods aim at the production of carbon steel strips having good properties of strength and ductility.

BACKGROUND OF THE INVENTION

In particular, in EP 0707908 A1 a twin roll continuous casting apparatus is shown and wherein a carbon steel strip is cast, for then undergoing in a hot rolling line with a 5–50% reduction of its thickness and being successively cooled. The flat thin product so obtained has good properties of strength and ductility thanks to the reduction in the grain dimension obtained with the hot rolling.

From WO 95/13155 an in line thermical treatment for cast carbon steel strips aiming at the control of a strip microstructure as cast is shown. In particular, the cast strip is cooled below the temperature wherein the transformation of austenite into ferrite occurs and the strip is successively heated until the material is riaustenitized (in line normalizing). In this way, for the effect of a double transformation phase into the solid phase, the austenitic grains become thinner, and by controlling the conditions of the final cooling and of the coiling of the strip it is possible to develop quite thin structures having good strength and ductility.

However, the above mentioned processes require further installations and higher energy consumption (e.g. rolling lines, furnace for intermediate heating etc.) and usually require larger space, and therefore less unity of the whole installation from the casting machine to the coiling reel. Furthermore, the object of the processes aim at the thickness of the final structure of the strip, trying to make it as similar as possible to that of a hot rolled strip from a conventional cycle, and they do not teach how to obtain a product with the desired mechanical and technological properties, by exploiting the peculiarities of the phase transformation features for the as cast steels with big austenitic grain (usually 150–400 microns).

SUMMARY OF THE INVENTION.

Therefore, an object the present invention is to provide a process for the production of low carbon steel strips having, as cast, a good combination of strength and ductility and a good weldability, without undergoing rolling and/or thermal cycling stages.

Another object of the present invention is to provide a carbon steel strip which has, as cast, improved mechanical properties, in particular a relatively low yield/fracture stress ratio and a continuous pattern of the tension-strain curve, in order to make the material particularly suitable for cold molding applications such as bending and drawing.

Therefore, an object of the present invention is a process for the production of low carbon steel strips having a good combination of strength and formability, as cast, and a good weldability after pickling by the usual processes, comprising the following steps:

casting, in a twin rolls continuous casting machine comprising pinch rolls, a strip with a thickness comprised between 1 and 8 mm, having the following composition as weight percentage of the total weight:

C 0.02–0.10; Mn 0.1–0.6; Si 0.02–0.35; Al 0.01–0.05; S<0.015; P<0.02; Cr 0.05–0.35; Ni 0.05–0.3; N 0.003–0.012; and optionally, Ti<0.03; V<0.10; Nb<0.035, the remaining part being substantially Fe;

cooling the strip in the area comprised between the casting-rolls and the pinch rolls;

hot deforming the strip cast through said pinch rolls at a temperature comprised between 1000 and 1300° C. until reaching a thickness reduction less than 15%, in order to encourage the closing of the shrinkage porosities;

cooling the strip at a speed comprised between 5 and 80° C./s down to a temperature comprised between 500 and 850° C.; and coiling in to a reel the so obtainable strip.

In the process of the present invention, the phase transformation features of coarse grain austenite, which formed during the continuous casting process without performing hot rolling and/or in line normalizing, are exploited to produce by a controlled cooling and coiling, predetermined volume divisions of the microstructure constituents in the material as cast in low carbon steels. These final microstructures, constituted by equiaxed ferrite, acicular ferrite and/or bainite, provide a typical stress-strain diagram, of the material, with a continuous pattern, having an improved deformability as to make the strip particularly suitable for the applications in cold molding.

BRIEF DESCRIPTION OF THE INVENTION

The present invention will be described herebelow according to a present embodiment thereof, given as a non-limiting example. Reference will be made to the figures in the annexed drawings, wherein:

FIG. 6(*b*) is a photographic illustration from an electron microscope of a particular of the ferrite of the acicular type obtained in a strip according to the present invention;

Figure 13A:
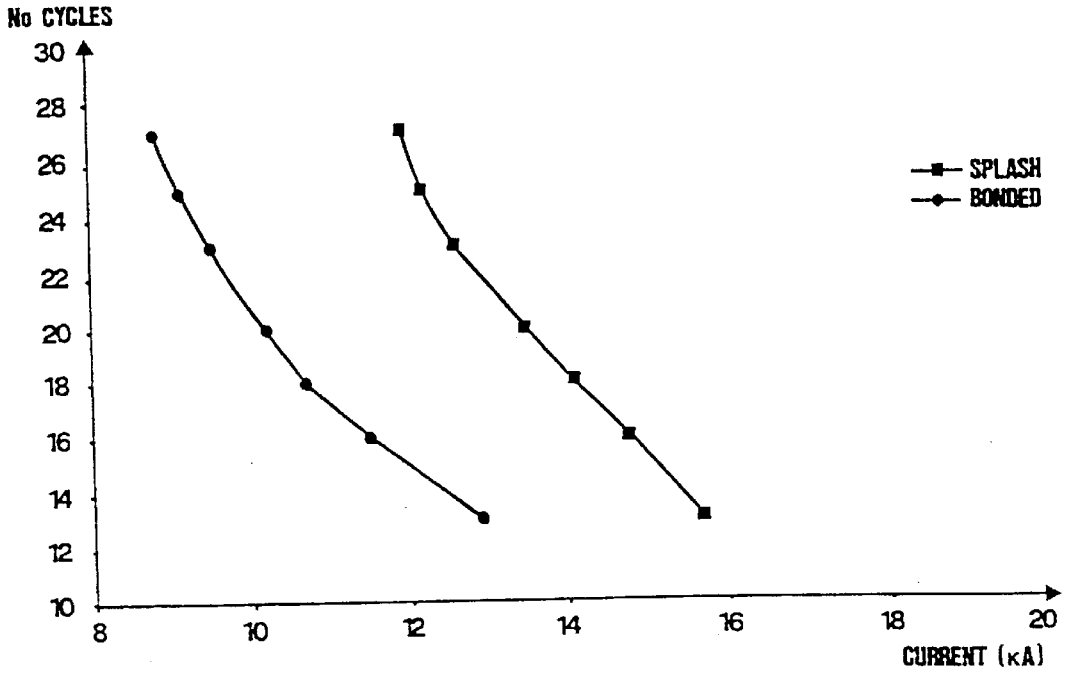
Figure 13B:
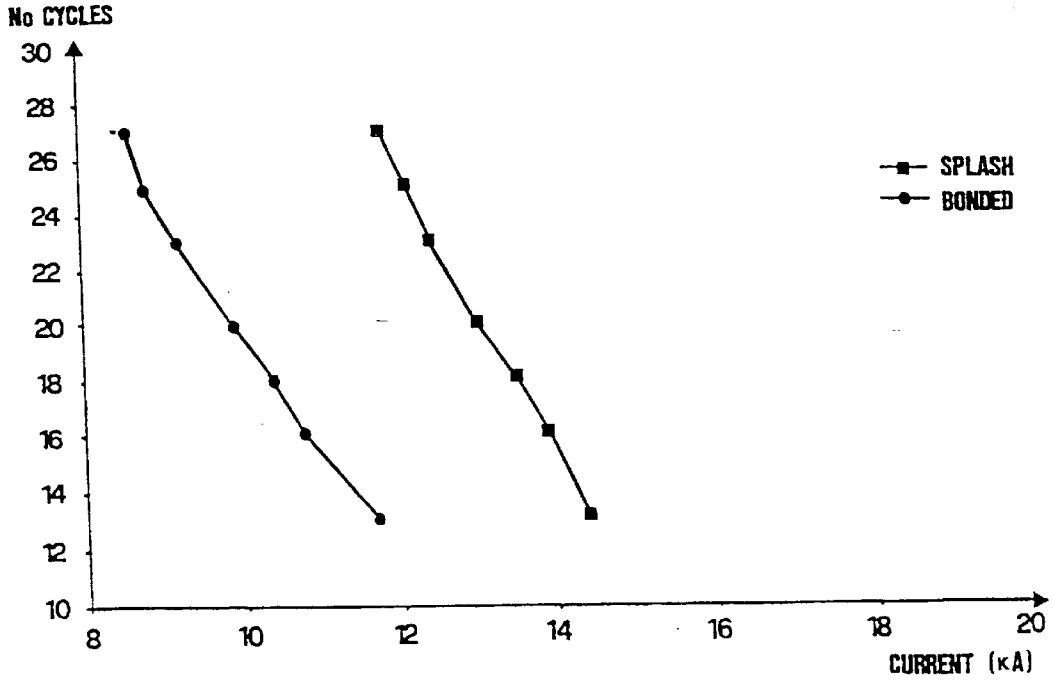
Figure 14:
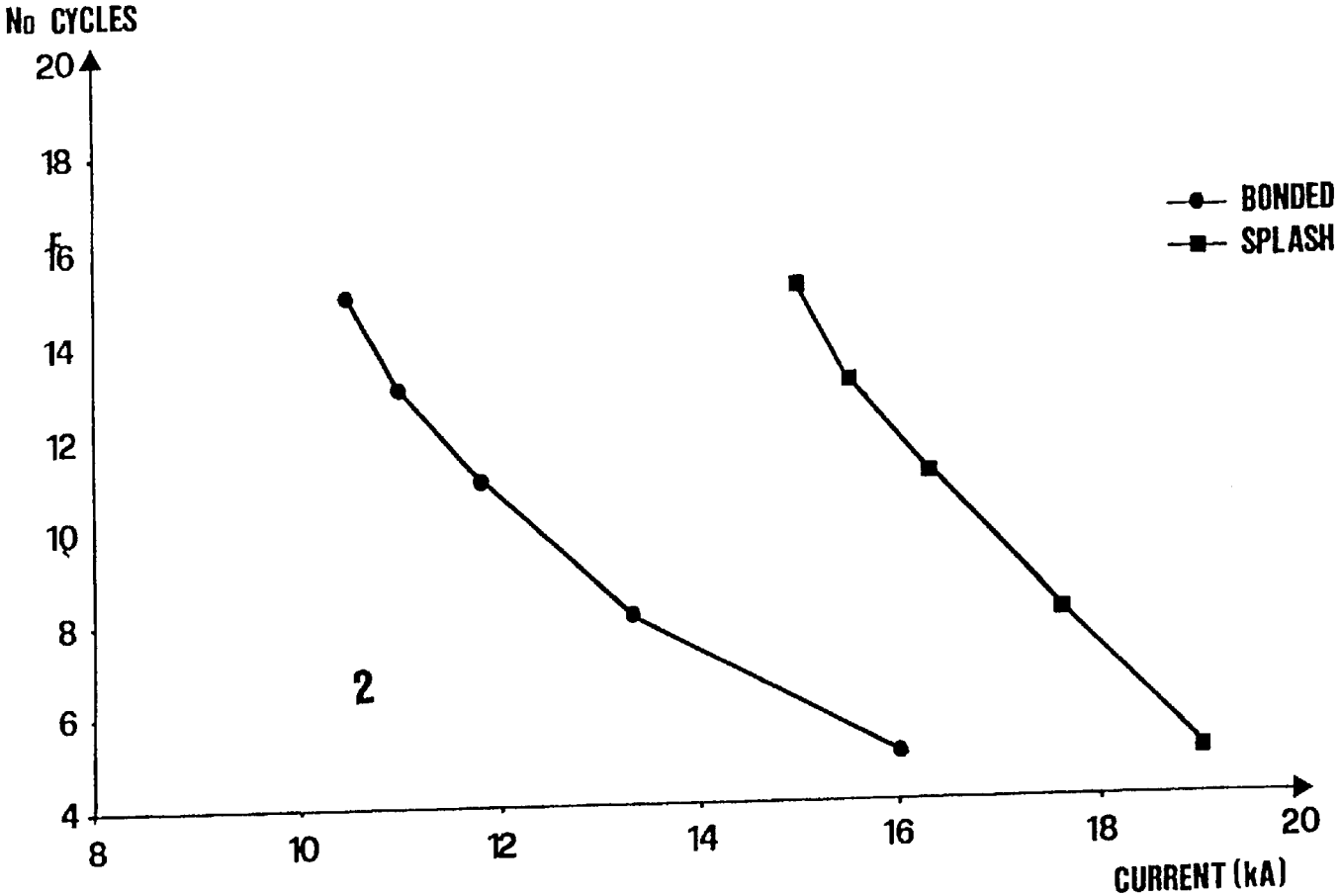

FIGS. 13(*a*) and 13(*b*) are diagrams representing the weldability lobes of two types of pickled steel strips obtained according to the process of the present invention; and FIG. 14 is a diagram representing the weldability lobes of a pickled low carbon steel strip obtained with a conventional cycle.

DETAILED DESCRIPTION OF THE INVENTION

Figure 1:
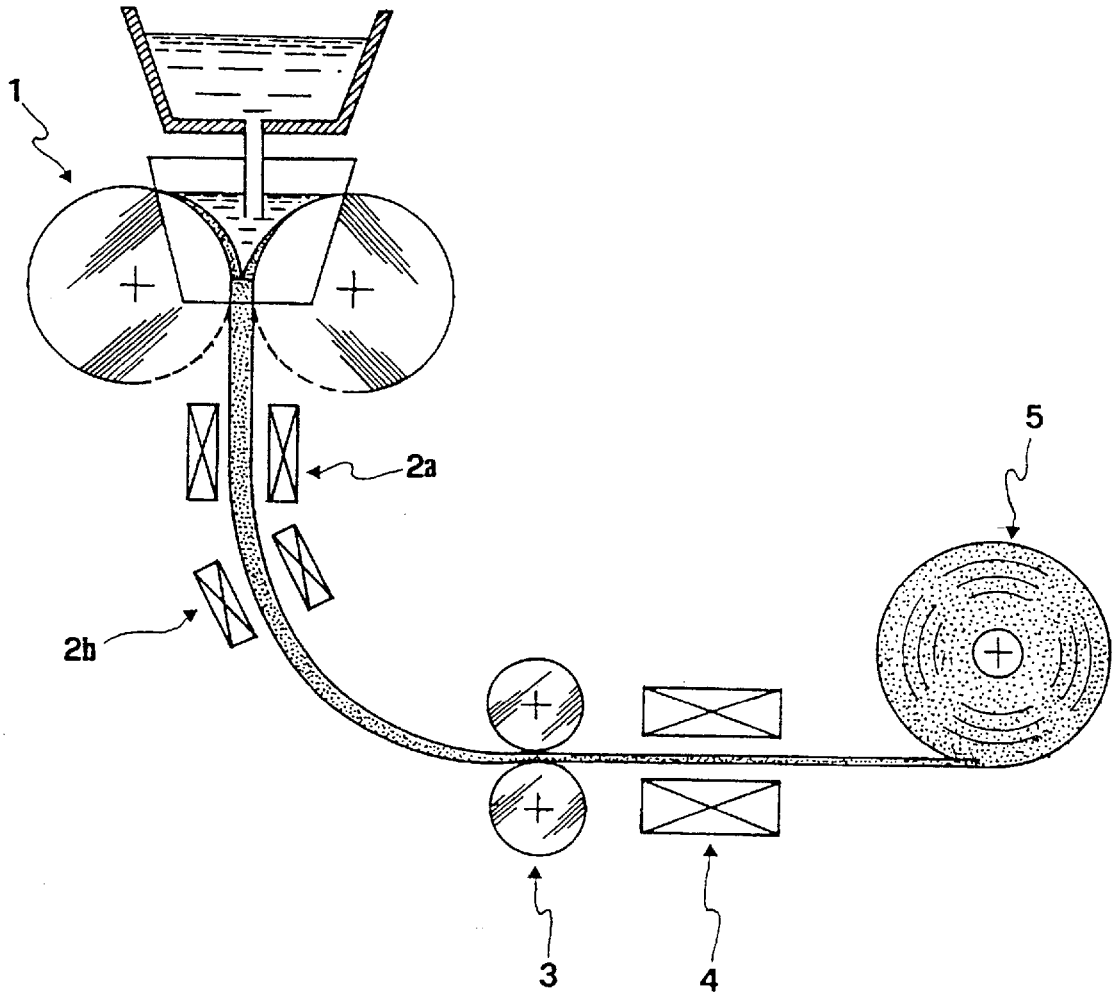
FIG. 1 is a simplified scheme of the twin roll continuous casting machine for thin strips and of the controlled cooling areas of the strips, according to the present invention.

With reference to FIG. 1, the process of the present invention provides the use of a twin rolls continuous casting apparatus 1. Immediately downstream of the rolls 1, two cooling devices 2*a* and 2*b* for a controlled cooling of the strip continuously passing therebetween are provided.

Successively to the abovementioned two cooling devices, pinch rolls 3 of an already known structure are provided.

At the outlet of the pinch rolls 3, a final modular cooling device 4 wherein the strip passes through to reach a coiling device 5 is provided.

During the solidification and the extraction from the casting device 1, the strip is subjected to a suitable controlled pressure by acting on the counterotating twin rolls, as to limit the formation of shrinkage porosities. Then, the cast strip undergoes water cooling or mixed water-gas cooling on both sides to slow the increase of growth of both the austenitic grains and the superficial oxides layers. By using the pinch rolls, the thickness is reduced to less than 15% at a temperature varying between 1000 and 1300° C. to close the porosities due to shrinkage at acceptable dimensions.

The cooling cycles of the as cast steel strips are set by acting on casting speed, water flows and number of active cooling areas. The final cooling cycle, after the pinch rolls 3, is defined on the basis of the phase transformation features of the steels, which depend mostly on the initial dimensions of the austenitic grains, and from the contents of C, Mn and Cr, in order to obtain the desired structures.

Various laboratory and full scale implantations trials were carried out, using steels whose composition was defined as follows:

C 0.02–0.10; Mn 0.1–0.6; Si 0.02–0.35; Al 0.01–0.05; S<0.015; P<0.02; Cr 0.05–0.35; Ni 0.05–0.3; N 0.003–0.012; Ti<0.03; V<0.10; Nb<0.035, the remaining part being substantially Fe.

From these trials it was evident that by controlling the chemical analysis of the steel and the in line cooling modes, it is possible to develop suitable final microstructures, characterized by definite fractions in volume of equiaxed ferrite and of acicular ferrite and/or bainite. The different division of the microstructure constituents so obtained, gives to the as cast strips different combinations of strength, ductility and cold formability, that can be evaluated through the stress and the Erichsen trials.

In particular, the inventors evaluated the properties connected with the formation of acicular ferrite or bainite structures, characterized by a high density of dislocations, compared with the traditional structures of polygonal thin grain ferrite.

According to the process of the present invention, on a low carbon steel strip, as cast, different types of structures and properties can be obtained, and such properties for each different type can be summarized as follows (the following capital letters mean different types of carbon steels):

A) Predominance of equiaxed ferrite
- acicular ferrite and/or bainite: <20% in volume
- coarse equiaxed grained ferrite: ≧70% in volume
- perlite: 2–10% in volume
- yield stress: Rs=180–250 MPa
- fracture stress: Rm≧280 MPa
- Rs/Rm ratio≦0.75
- total elongation: ≧30%
- Erichsen index: ≧12 mm B) Mixed structure of equiaxed and acicular ferrite
- acicular ferrite and/or bainite: 20–50% in volume
- coarse equiaxed grained ferrite: <80% in volume
- perlite: <2% in volume
- yield stress: Rs=200–300 MPa
- fracture stress: Rm≧300 MPa
- Rs/Rm ratio=≦0.75
- total elongation: ≧28%
- Erichsen index: ≧11 mm C) Predominance of acicular ferrite-bainite
- acicular ferrite and/or bainite: >50% in volume
- coarse equiaxed grained ferrite: <50% in volume
- perlite: <2% in volume
- yield stress: Rs=210–20 MPa
- fracture stress: Rm>330 MPa
- Rs/Rm ratio≦0.8
- total elongation: ≧22%
- Erichsen index: ≧10 mm It was found out that C, Mn and Cr, in the weight concentrations defined in the scope of the present invention, and austenitic grains whose dimensions are more than 150 μm, as well as a cooling speed of>10° C./s in the temperature interval 750–480° C., encourage the formation of non equiaxed ferrite.

Further trials conducted according to the process described in the present invention showed that it is possible to exploit the larger distribution and concentration uniformity of the alloy components in cast strips with a high solidification speed (low entity of the segregation) in order to homogenize the distribution of the microstructures and to avoid the formation of undesired structures, of the martenistic type, reducing the ductility and the formability of the material.

Furthermore, the inventors discovered that the energic cooling of the cast strip is effective to obtain a superficial oxide scale whose thickness and nature are such as to be removed, using the traditional pickling processes. Through point welding trials of pickled strips specimen, obtained with the process of the present invention, the weldability of the materials was checked which as it is well known, is strongly influenced by the superficial condition of the sheet-steel.

Furthermore, the inventors observed how the addition of elements such as vanadium and niobium, increased the hardenability of austenite and delayed the formation of equiaxed ferrite, easing the development of acicular ferrite and bainite. Furthermore, niobium and titanium, forming carbon-nitrides, inhibit the dimensional growth of the austenitic grains in high temperature heating processes, ensuring, for example, a better ductility in the thermally altered area of a welding.

The present illustrative and comparative examples of microstructures and properties of strips obtained both by the process of the present invention and with conventional technologies, will be described herebelow given as a non-limiting example. For clearness sake, the tables mentioned in the following examples are illustrated all together after the last example (Example $n^34$).

EXAMPLE 1

Some cast strips having a thickness comprised between 2.2 and 2.4 mm were obtained according to the process of the present invention, by using the A type steel (as above already disclosed), whose analysis is reported in table 1.

Figure 2:
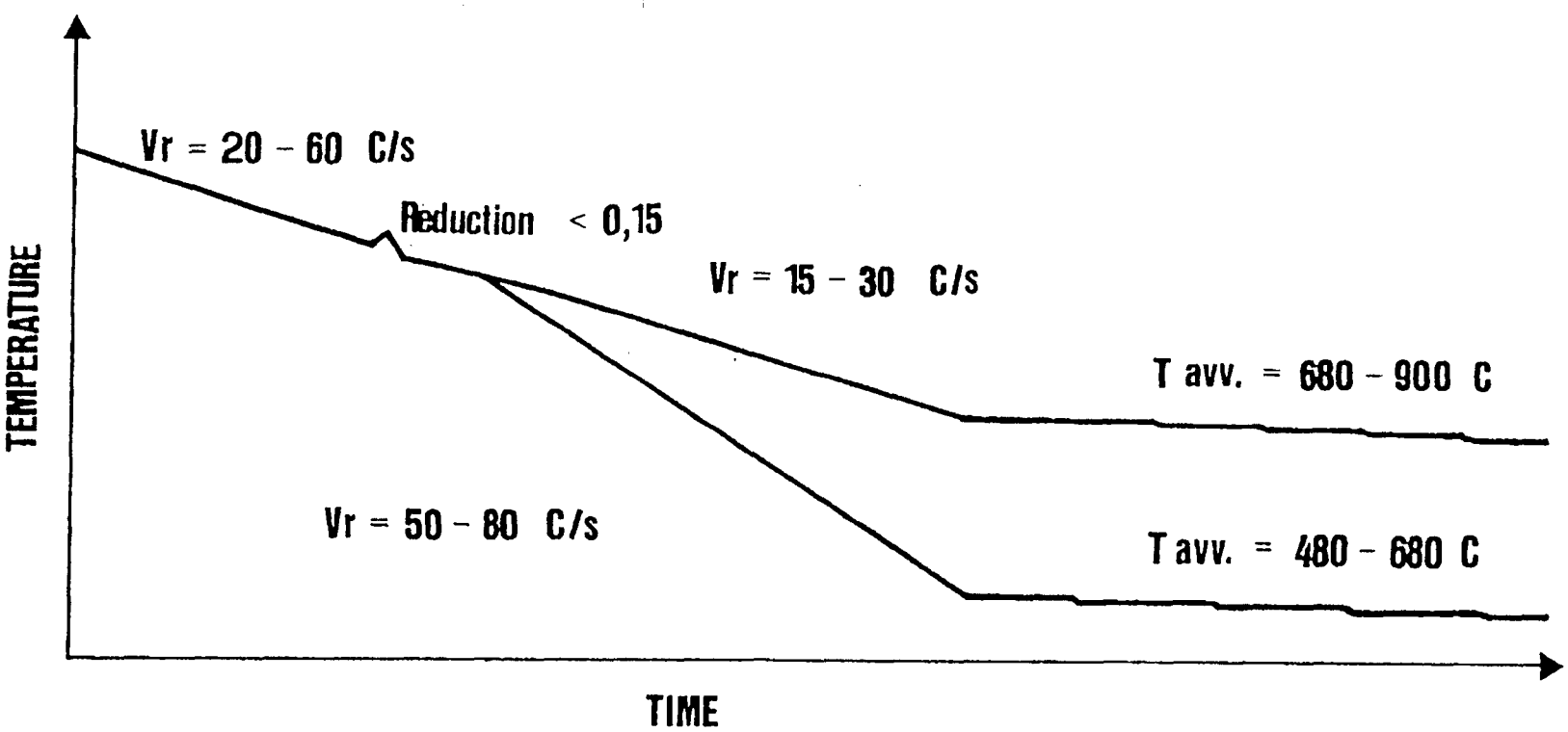
FIG. 2 is a schematic diagram of the in line cooling cycles applied to as cast strips.

The liquid steel was cast in a vertical twin roll continuous casting machine. (FIG. 1) and by using an average separating stress of 40 t/m. The strips were cooled at the outlet of the casting machine until they reached a temperature of 1210–1170° C. at the proximity of the pinch rolls 3. A these temperatures the thickness was reduced by about 10%. Successively, the cooling was modulated, as it is schematically indicated in FIG. 2, to have a cooling speed comprised between 10 and 40° C./s in the interval comprised between 950° C. and the coiling temperature. The latter was made variable between 780 and 580° C. The main cooling and coiling conditions are shown in table 2, together with some microstructure features of the produced strips. The mechanical properties of the strips concerning the yield stress Rs, defined as ReL or Rp0.2 (depending if the yield is continuous or discontinuous), the fracture stress, Rm, the Rs/Rm ratio, the total elongation, A%, and the Erichsen index (I.AND.), measure of the cold formability of the materials, are reported in table 3.

Figure 3:
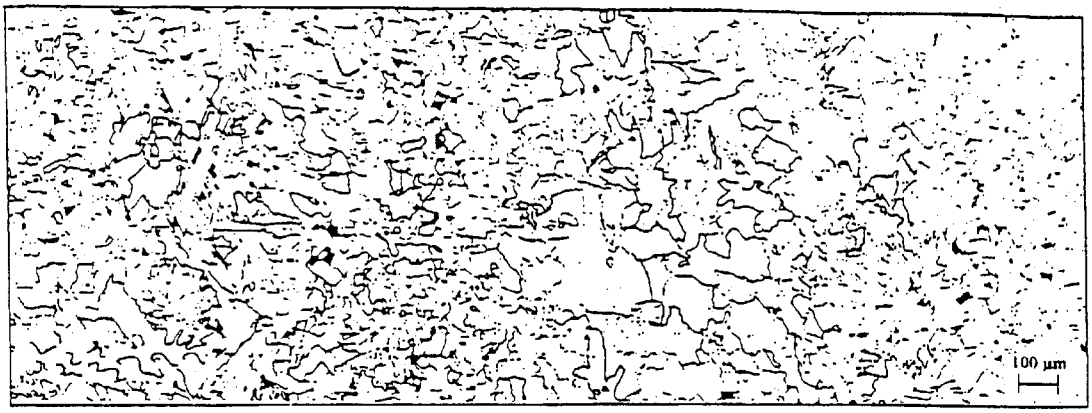
FIG. 3 is a photographic illustration from an optical microscope of the microstructure of a first type of an as cast steel strip cooled according to the present invention.
Figure 4:
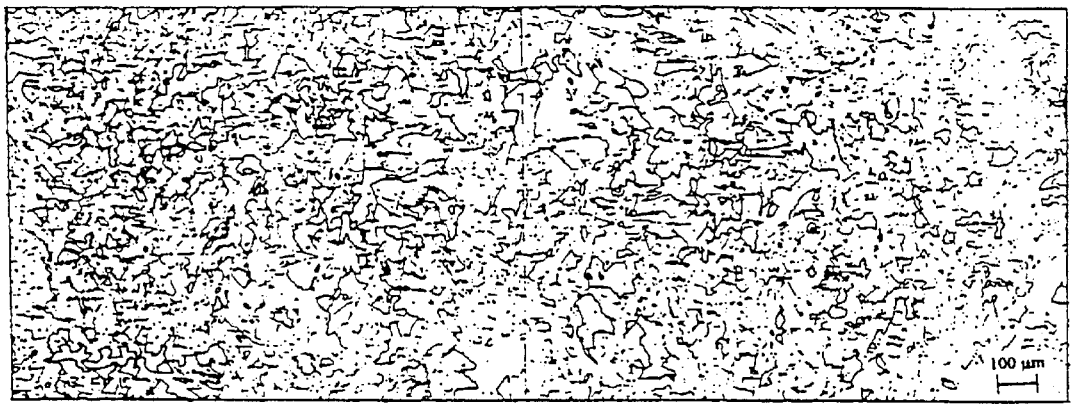
FIG. 4 is a photographic illustration from an optical microscope of the microstructure of a second type of as cast steel strip, cooled according to the present invention.
Figure 5:
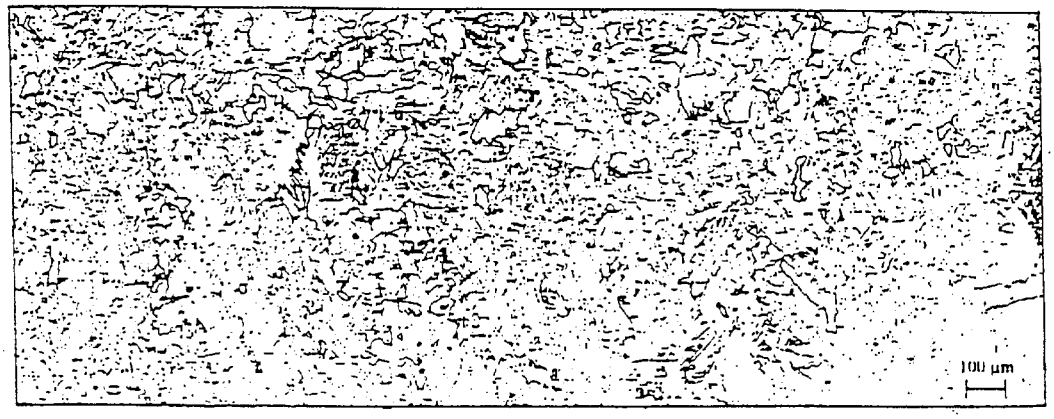
FIG. 5 is a photographic illustration from an optical microscope of the microstructure of a third type of as cast steel strip, cooled according to the present invention.

In FIGS. 3–5, the typical microstructures respectively of the strips coiled at 760–730° C. (strips 9 and 4) and at 580° C. (strip 5), as observable through an optical microscope, are shown.

Figure 6A:
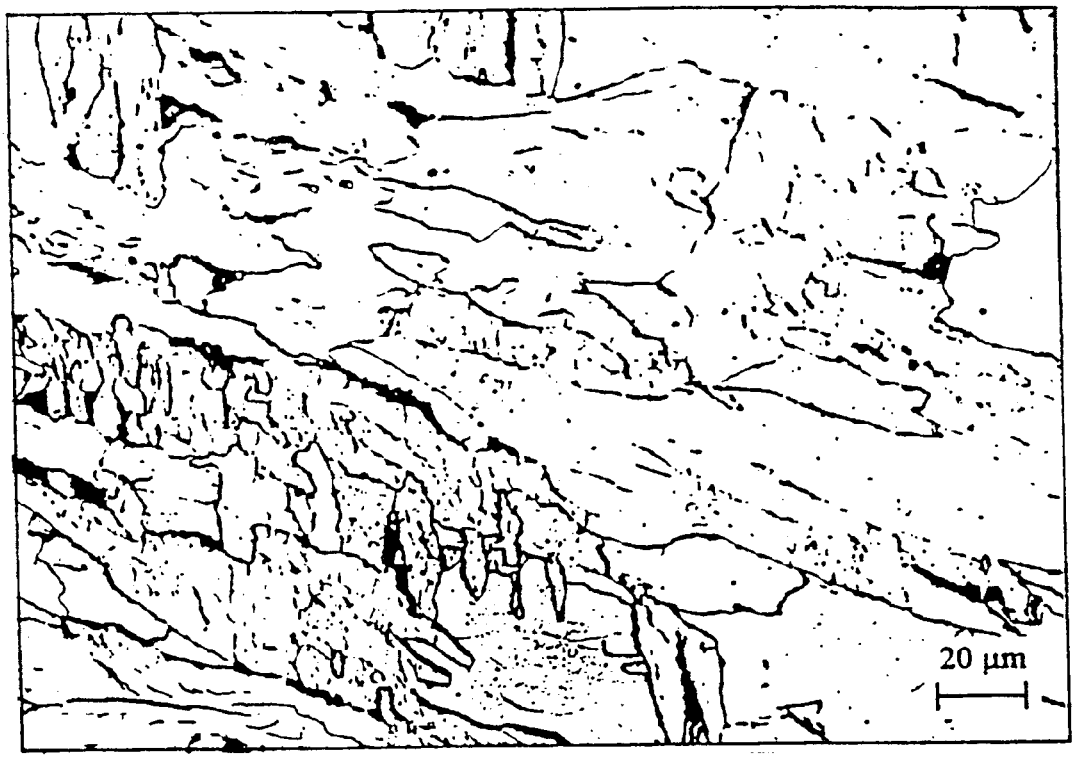
FIG. 6(*a*) is a photographic illustration from an optical microscope of a ferrite of the acicular type in particular obtained in a strip according to the present invention.
Figure 6B:
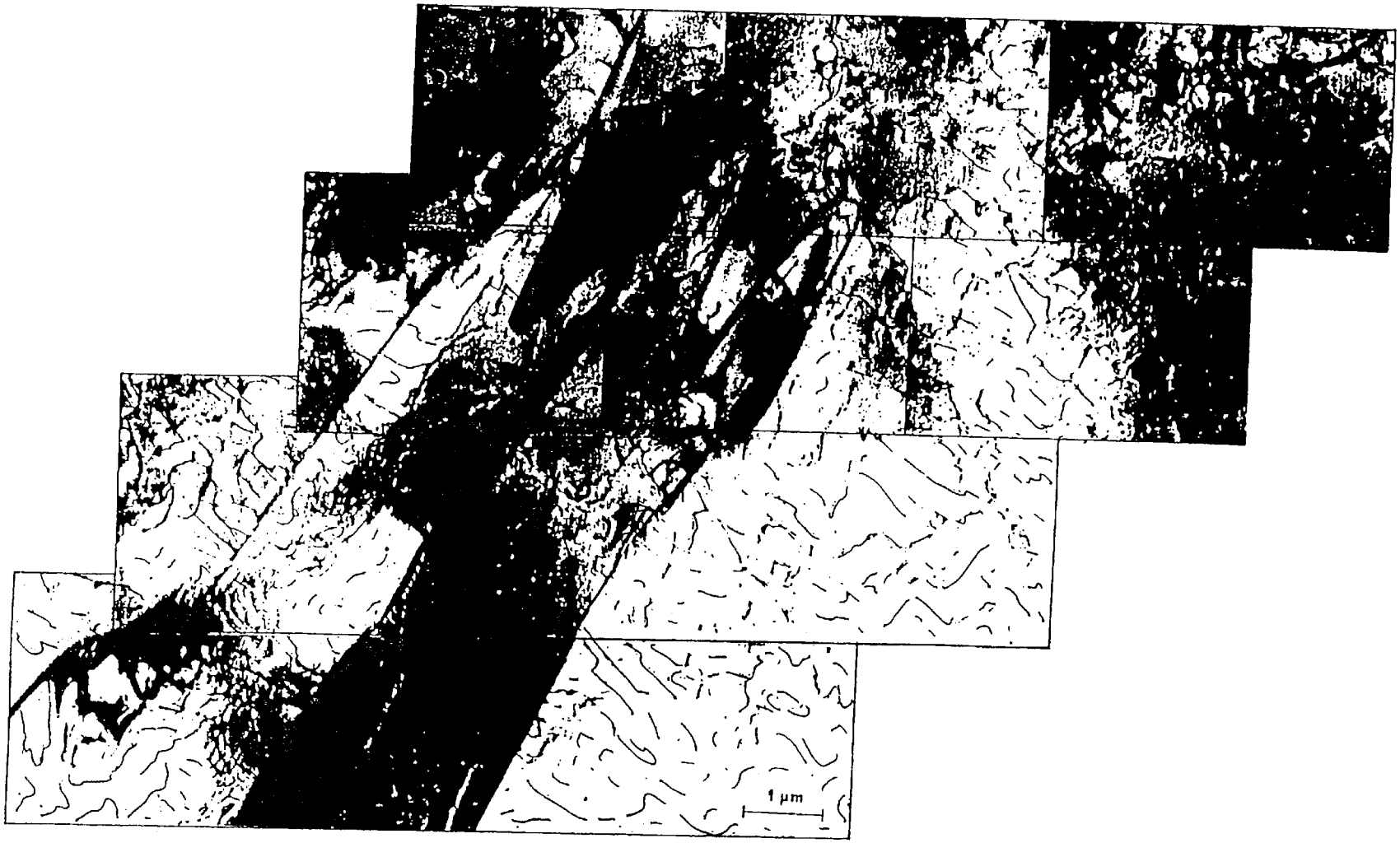

It is observed how, when the coiling temperature decreases and the average cooling speed of the strip increases, perlite practically disappears and acicular ferrite and/or bainite structures, whose detail is shown in FIG. 6, develop. Said microstructures lead to a yield of the material of the continuous type (Table. 3).

EXAMPLE 2

Other strips having a thickness of 2.0–2.5 mm were obtained with the process of the present invention, by using the B and C types of steel of table 1, having a higher carbon content (0.052% and 0.09%, respectively).

The main cooling and coiling conditions are shown in table 4, together with some microstructure features of the strips so obtained. The mechanical properties of the strips and the Erichsen index, measure of the cold formability of the materials, are reported in table 5.

Figure 7:
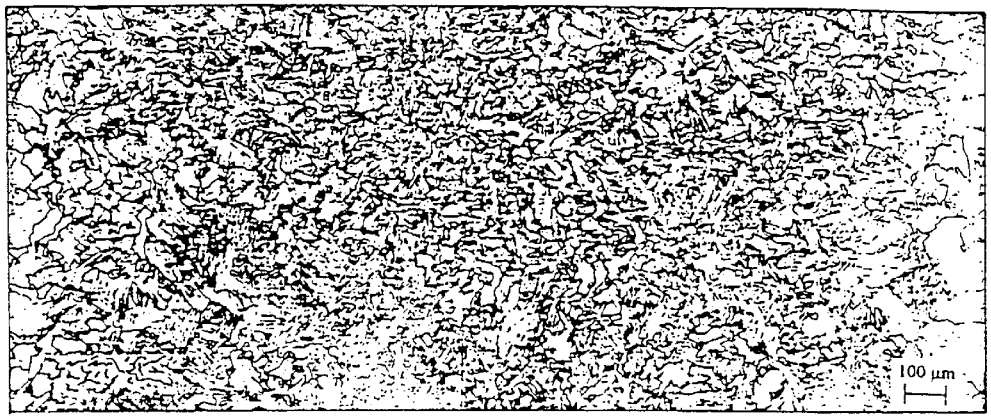
FIG. 7 is a photographic illustration from an optical microscope of the microstructure of a second type of as cast steel strip, cooled according to the present invention.
Figure 8:
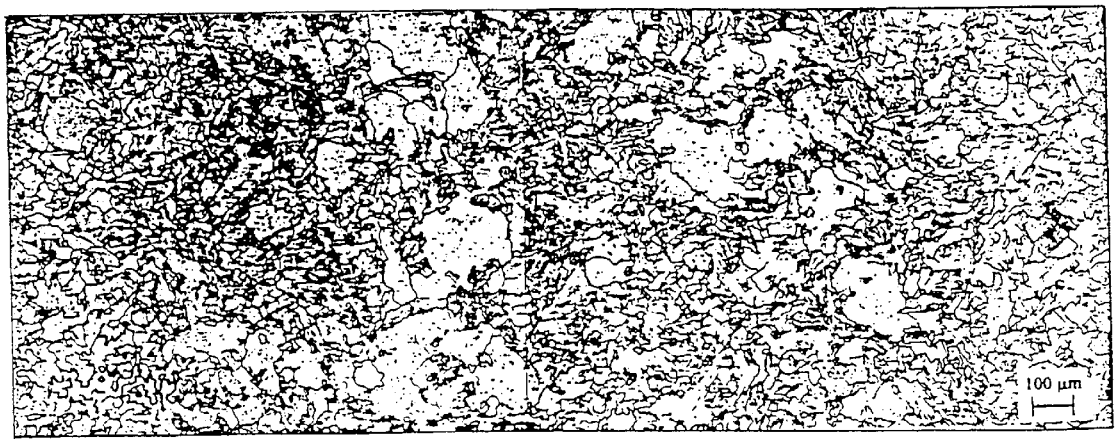
FIG. 8 is a photographic illustration from an optical microscope of the microstructure of a third type of as cast strip steel, cooled according to the present invention.

In FIGS. 7 and 8 the typical microstructures respectively of the strips 7 (steel B) and 14 (steel C), as observed through an optical microscope, are shown. Also in this case, by exploiting the phase transformation features of the coarse austenitic grain steels, it is possible to obtain mixed structures containing equiaxed ferrite and also acicular ferrite and bainite. The strength values are higher than those shown in example 1, relating to steel having 0.035% C, and ductility and cold formability remain at good values.

EXAMPLE 3

Figure 9:
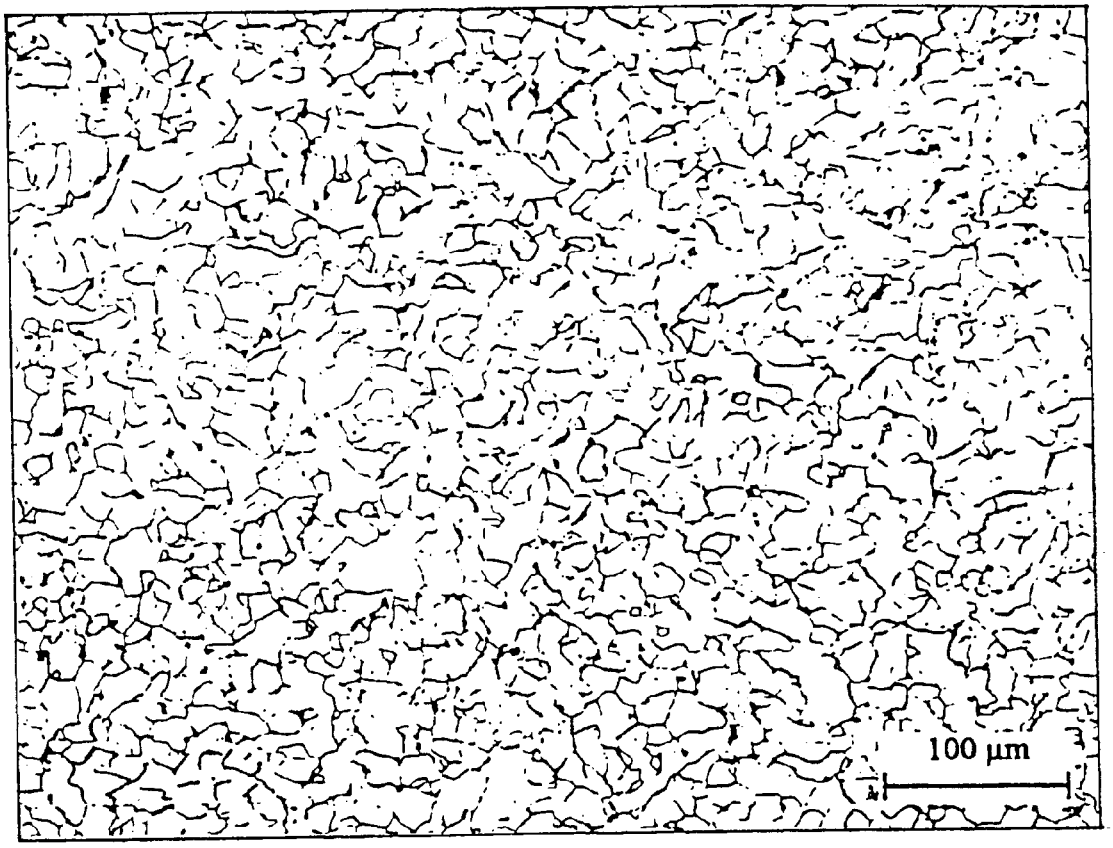
FIG. 9 is a photographic illustration from an optical microscope of the microstructure of a fourth type of steel strip produced with a traditional cycle.
Figure 10:
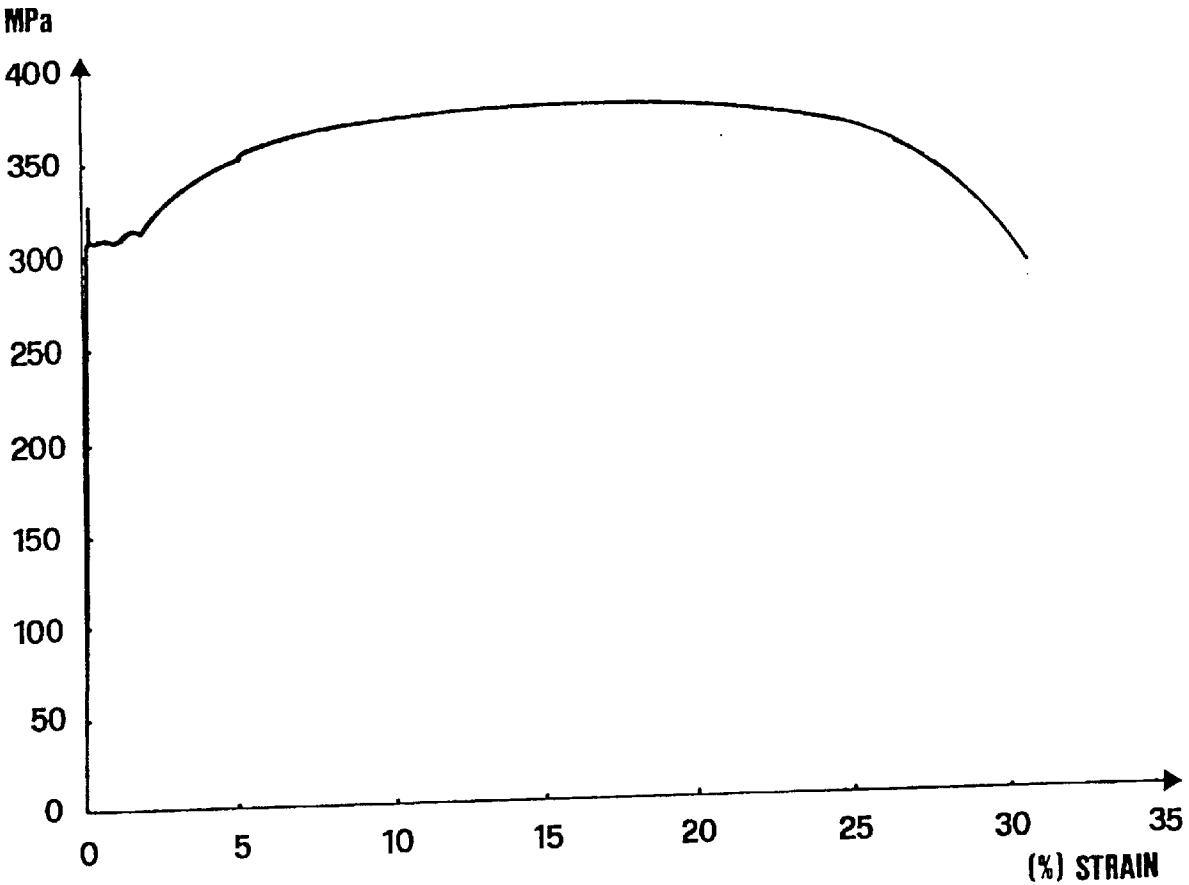
FIG. 10 is a tensile stress diagram of a strip of a type of steel.
Figure 11:
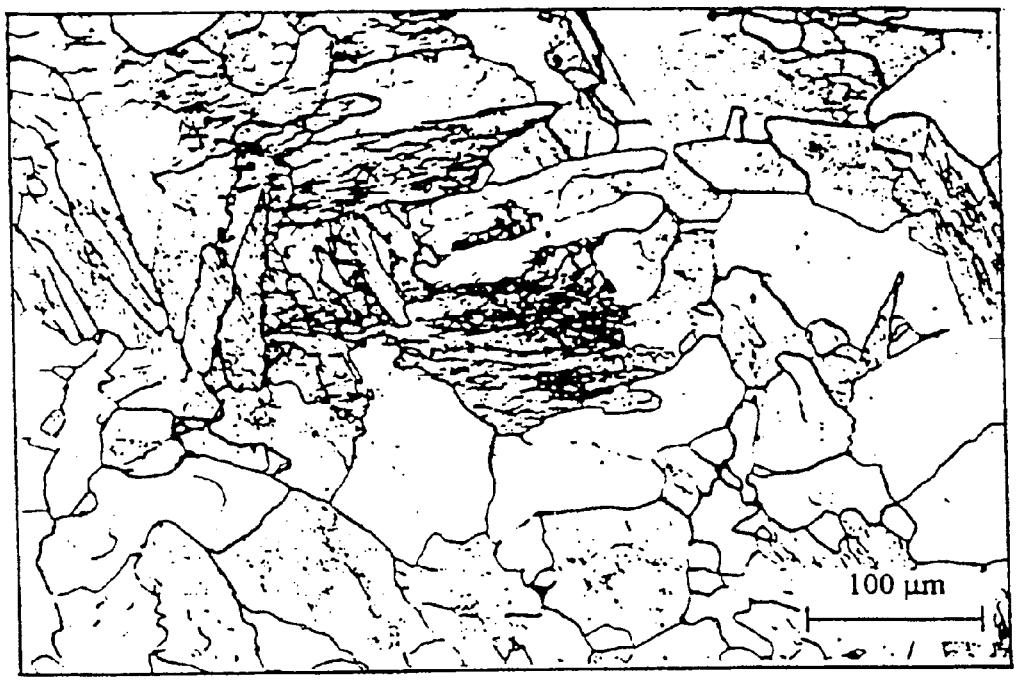
FIG. 11 is a photographic illustration from an optical microscope of the microstructure of as cast steel strip, produced according to the process of the present invention.
Figure 12:
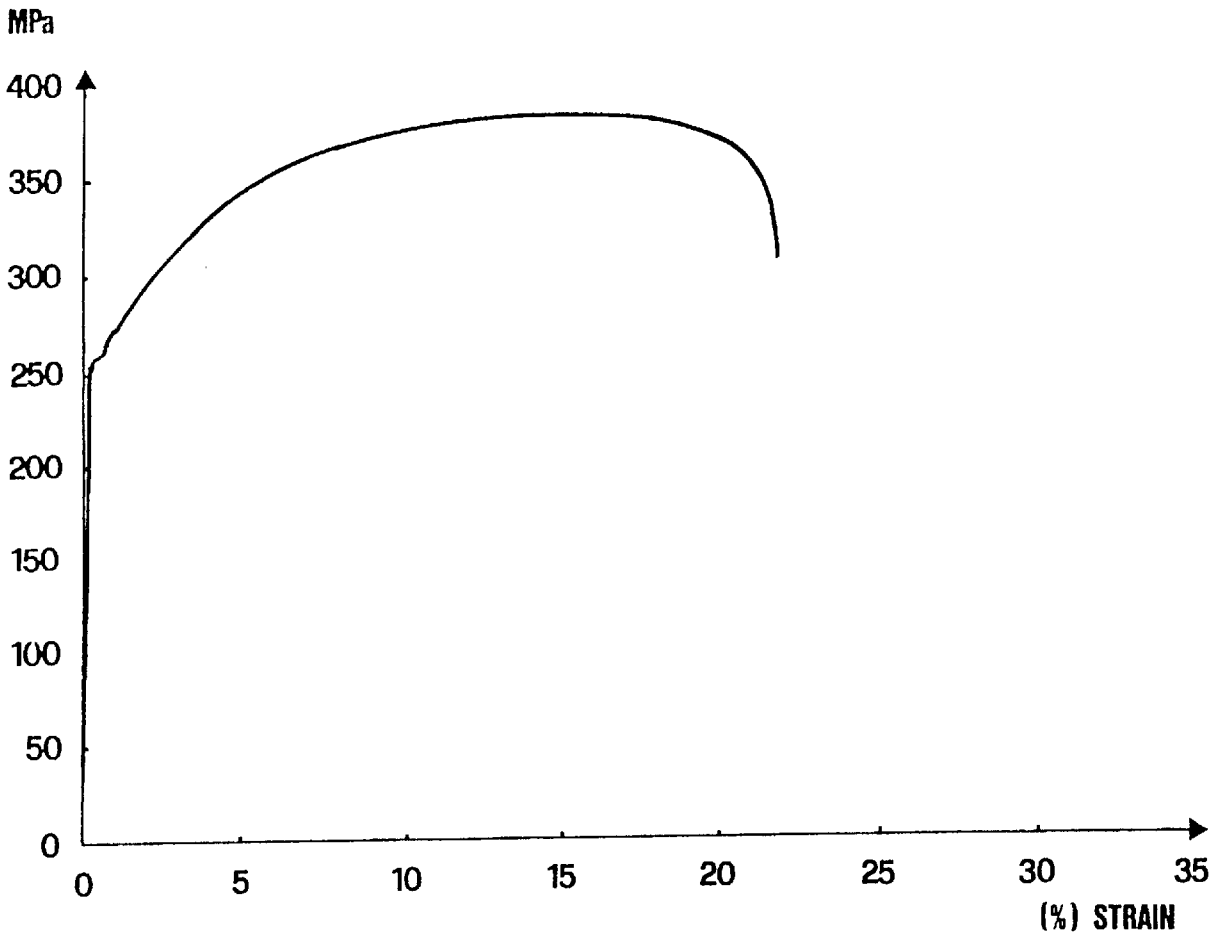
FIG. 12 is a diagram of the tensile stress diagram in a continuous pattern of an as cast steel strip obtained according to the process of the present invention.

In this comparative example, the microstructures and the mechanical properties of a strip having a thickness of 2 mm and obtained with the steel of the D type (table 1) produced with a traditional cycle and comparing with those of a strip as cast, having the same chemical analysis, produced according to the process of the present invention, are reported. Clearly, the microstructure of the traditional strip is constituted by thin grains of polygonal ferrite and by perlite (FIG. 9), with a tensile stress diagram of a discontinuous pattern (FIG. 10). The typical mechanical properties of this conventional strip are shown in table 6. The use of relatively low coiling temperatures (table 7), with the process of the present invention allows the use of materials with acicular structures of the type as shown in FIG. 11, which are characterized by similar values of fracture stress, with a continuous pattern yield diagram (FIG. 12), and therefore with a lower yield/fracture stress ratio (table 8).

EXAMPLE 4

Some strips obtained according to the process of the present invention and made by the A and B types of steels, were pickled and underwent weldability trials. The point resistance welding trials were performed with electrodes having a diameter of 8 mm, adopting a stress of 650 kg, and by varying the current. In FIGS. 13*a* and 13*b* the diagrams that at the "number of cycles-current intensity" level provide weldability lobes, i.e. the field wherein the steel sheets are weldable without problems, are respectively shown. The comparison with a pickled sheet-steel having similar thickness, in low carbon steel obtained by a conventional production cycle (FIG. 14), shows how the strips obtained with the process of the present invention keep good weldability features, as to indicate an acceptable superficial state.

TABLE 1

Chemical analysis of the steels used in the examples

| Steel | C | Mn | Si | Cr | Ni | S | P | Al | N |
|---|---|---|---|---|---|---|---|---|---|
| A | 0.038 | 0.48 | 0.16 | 0.31 | 0.13 | 0.008 | 0.016 | 0.044 | 0.01 |
| B | 0.052 | 0.45 | 0.16 | 0.22 | 0.08 | 0.004 | 0.008 | 0.021 | 0.0086 |
| C | 0.090 | 0.59 | 0.31 | 0.09 | 0.07 | 0.014 | 0.008 | 0.010 | 0.0088 |
| D | 0.034 | 0.22 | 0.02 | 0.05 | 0.06 | 0.003 | 0.008 | 0.035 | 0.0080 |

TABLE 2

Cooling conditions and final microstructures of the as cast A type of steel strips used in the examples

| | | | Microstructure (% in volume) | | |
|---|---|---|---|---|---|
| Strip No of trial | Vr (° C./s) | Tavv (° C./s) | Equiaxed ferrite | Acicular ferrite + bainite | Perlite |
| 9 | 15 | 760 | 56 | 40 | 4 |
| 4 | 34 | 730 | 40 | 58 | 2 |
| 3 | 30 | 680 | 50 | 50 | 2 |
| 11 | 15 | 620 | 50 | 50 | 1 |
| 5 | 26 | 580 | 10 | 90 | 0 |

TABLE 3

Mechanical properties of the as cast A type of steel strips used in the examples

| Strip No. of trial | Vr (° C./s) | Tavv (° C./s) | ReL (MPa) | Rp0.2 (MPa) | Rm (MPa) | Rs/Rm | A (%) | I.E. (mm) |
|---|---|---|---|---|---|---|---|---|
| 9 | 15 | 760 | — | 250 | 351 | 0.71 | 30 | 12.7 |
| 4 | 34 | 730 | — | 264 | 351 | 0.75 | 28 | 12.5 |
| 3 | 30 | 680 | — | 250 | 338 | 0.74 | 28 | 12.6 |
| 11 | 15 | 620 | — | 251 | 355 | 0.70 | 28 | 11.4 |
| 5 | 26 | 580 | — | 306 | 384 | 0.79 | 22 | 11.0 |

TABLE 4

Cooling conditions and final microstructures in the as cast B and C types of steel strips used in the example

| Steel type/strip | Vr ° C./s | Tavv (° C./s) | Microstructure (% in volume) Equiaxed ferrite | Acicular ferrite + bainite | Perlite |
|---|---|---|---|---|---|
| B/8 | 20 | 860 | 67 | 2 | 6 |
| B/6 | 20 | 610 | 40 | 59 | 1 |
| B/7 | 25 | 500 | 20 | 80 | 0 |
| C/13 | 20 | 820 | 80 | 15 | 5 |
| C/14 | 25 | 620 | 30 | 70 | 0 |

TABLE 5

Mechanical properties of the B and C types of steel strips as cast

| Steel type/Strip | Vr (° C./s) | Tavv (° C./s) | ReL (MPa) | Rp0.2 (MPa) | Rm (MPa) | Rs/Rm | A (%) | I.E. (mm) |
|---|---|---|---|---|---|---|---|---|
| B/8 | 20 | 860 | 258 | — | 343 | 0.75 | 26 | 12.5 |
| B/6 | 20 | 610 | | 267- | 353 | 0.76 | 24 | 12.4 |
| B/7 | 25 | 500 | — | 320 | 406 | 0.79 | 22 | 12.2 |
| C/13 | 20 | 820 | 202 | — | 310 | 0.65 | 30 | 11.4 |
| C/14 | 25 | 620 | — | 253 | 344 | 0.73 | 22 | 10.3 |

TABLE 6

Mechanical properties of strips from a conventional cycle in the steel D

| Steel type/Strip | Vr (° C./s) | Tavv (° C./s) | ReL (MPa) | Rp0.2 (MPa) | Rm (MPa) | Rs/Rm | A (%) | I.E. (mm) |
|---|---|---|---|---|---|---|---|---|
| D/7 | 2 | 30 | 640 | 323 | 383 | 0.84 | 30 | 13.3 |
| D/8 | 4 | 20 | 650 | 303 | 372 | 0.81 | 35 | — |

TABLE 7

Cooling conditions and final microstructures in the D type steel strips as cast and having a thickness of 2 and 4 mm

| Steel type/Streep | Thickness (mm) | Vr (° C./s) | Tavv (° C.) | Microstructure Equiaxed ferrite | Acicular ferrite + bainite | Perlite |
|---|---|---|---|---|---|---|
| D/3 | 2 | 50 | 720 | 30 | 70 | 0 |
| D/5 | 2 | 80 | 720 | 40 | 60 | 0 |
| D/2 | 2 | 15 | 620 | 50 | 50 | 0 |
| D/4 | 2 | 80 | 620 | 25 | 75 | 0 |
| D/6 | 4 | 50 | 620 | 40 | 60 | 0 |

TABLE 8

Mechanical properties of the D type steel strips as cast

| Steel type/Strip | Vr (° C./s) | Tavv (° C./s) | ReL (MPa) | Rp0.2 (MPa) | Rm (MPa) | Rs/Rm | A (%) | I.E. (mm) |
|---|---|---|---|---|---|---|---|---|
| D/3 | 50 | 720 | 287 | — | 390 | 0.74 | 26 | — |
| D/5 | 80 | 720 | — | 238 | 356 | 0.67 | 31 | — |
| D/2 | 15 | 620 | — | 223 | 366 | 0.61 | 27 | — |
| D/4 | 80 | 620 | — | 259 | 380 | 0.68 | 25 | 13.0 |
| D/6 | 50 | 620 | — | 196 | 338 | 0.58 | 38 | — |

What is claimed is:

1. A process for the production of low carbon steel strips having a good combination of strength and formability, as cast, and a good weldability after pickling, comprising the following steps:

casting, in a twin rolls continuous casting machine (1) comprising pinch rolls (3), a strip with a thickness between 1 and 8 mm, and with coarse austenitic grains of 150–400 microns having the following composition as weight percentage of the total weight:

C 0.02–0.10; Mn 0.1–0.6; Si 0.02–0.35; Al 0.01–0.05; S<0.015; P<0.02; Cr 0.05–0.35; Ni 0.05–0.3; N 0.003–0.012; and optionally, Ti<0.03; V<0.10; Nb<0.035, the remaining part being substantially Fe;

cooling the strip in an area between casting-rolls and the pinch rolls (3);

hot deforming the strip cast through said pinch rolls (3) at a temperature between 1000 and 1300 degrees C. until the strip reaches a thickness reduction less than 15%, sufficient to encourage closing of the shrinkage porosities, but without refining the coarse grain austenite of the cast strip;

cooling the strip at a speed between 5 and 80 degrees C./s to a temperature (Tavv) between 500 and 850 degrees C.; and coiling the strip in to a reel (5).

2. The low carbon cast steel strip, obtained by the process according to claim 1 and which has low segregation and predetermined mixed microstructures comprising acicular ferrite and/or bainite, such microstructures providing a low yield/fracture stress ratio and a continuous pattern of a stress-strain diagram of the material, as well as a good weldability after the strip has been pickled.

3. A low carbon steel strip according to claim 2, having the following final microstructure and mechanical properties:

acicular ferrite and/or bainite: <20% in volume coarse equiaxed grained ferrite: ≧70% in volume perlite: 2–10% in volume yield stress: Rs=180–250 MPa fracture stress: Rm≧280 MPa Rs/Rm ratio≦0.75 total elongation: >30%

Erichsen index: ≧12 mm.

4. A low carbon steel strip according to claim 2, having the following final microstructure and mechanical properties:

acicular ferrite and/or bainite: 20–50% in volume coarse equiaxed grained ferrite: <80% in volume perlite: <2% in volume yield stress: Rs=200–300 MPa fracture stress: Rm≧300 MPa Rs/Rm ratio≦0.75 total elongation: ≧28%

Erichsen index: ≧11 mm.

5. A low carbon steel/strip according to claim 2, having the following final microstructure and mechanical properties:

acicular ferrite and/or bainite: >50% in volume coarse equiaxed grained ferrite: <50% in volume perlite: <2% in volume yield stress: Rs=210–350 MPa fracture stress: Rm>330 MPa.

Rs/Rm ratio=≦0.8 total elongation: ≧22%

Erichsen index: ≧10 mm.

* * * * *